US009601884B2

(12) United States Patent
Komoto et al.

(10) Patent No.: US 9,601,884 B2
(45) Date of Patent: Mar. 21, 2017

(54) CONNECTOR

(71) Applicant: Japan Aviation Electronics Industry, Limited, Tokyo (JP)

(72) Inventors: Tetsuya Komoto, Tokyo (JP); Yu Tatebe, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/082,953

(22) Filed: Mar. 28, 2016

(65) Prior Publication Data

US 2016/0372875 A1 Dec. 22, 2016

(30) Foreign Application Priority Data

Jun. 18, 2015 (JP) ..... 2015-122951

(51) Int. Cl.

| | |
|---|---|
| ***H01R 25/00*** | (2006.01) |
| ***H01R 24/60*** | (2011.01) |
| ***H01R 13/04*** | (2006.01) |
| ***H01R 13/10*** | (2006.01) |
| ***H01R 13/631*** | (2006.01) |
| *H01R 107/00* | (2006.01) |

(52) U.S. Cl.

CPC ..... *H01R 24/60* (2013.01); *H01R 13/04* (2013.01); *H01R 13/10* (2013.01); *H01R 13/631* (2013.01); *H01R 2107/00* (2013.01)

(58) Field of Classification Search

CPC ..... H01R 24/60; H01R 13/04; H01R 13/10; H01R 13/631; H01R 2107/00

USPC ..... 439/676, 64, 284, 293, 292, 295, 378

See application file for complete search history.

(56) References Cited

U.S. PATENT DOCUMENTS 3,622,936 A * 11/1971 Negishi ..... H05K 3/365 24/411
4,931,021 A * 6/1990 Mohan ..... G02B 6/3833 439/284
7,179,108 B2 * 2/2007 Goodman ..... H01R 12/714 439/284
7,438,482 B2 * 10/2008 Asari ..... G02B 6/43 385/89

(Continued)

FOREIGN PATENT DOCUMENTS

JP 4-308674 A 10/1992

*Primary Examiner* — Abdullah Riyami
*Assistant Examiner* — Nelson R Burgos-Guntin
(74) *Attorney, Agent, or Firm* — Muncy, Geissler, Olds & Lowe, P.C.

(57) ABSTRACT

A connector includes a first connector having first female contacts, first male contacts and a first insulation portion disposed between each first female contact and an adjacent first male contact, and a second connector having second female contacts, second male contacts and a second insulation portion disposed between each second female contact and an adjacent second male contact, provided that a width of each first female contact and second female contact on fitting is denoted by W1, a width of the first insulation portion and the second insulation potion by W2, and a width of each first male contact and second male contact by W3, a distance between centers of one first female contact and an adjacent first male contact and a distance between centers of one second female contact and an adjacent second male contact are each smaller than a sum of W1/2, W2 and W3/2.

7 Claims, 6 Drawing Sheets

(56) References Cited

U.S. PATENT DOCUMENTS

2007/0298644 A1* 12/2007 Goodman ..... H01R 23/27
439/284

* cited by examiner

CONNECTOR

BACKGROUND OF THE INVENTION

The present invention relates to a connector, in particular, to a connector comprising a first connector and a second connector, the first connector and the second connector sliding on each other in a fitting direction to be fitted with each other.

As a connector of this type, for example, JP 4-308674 A discloses a connector as illustrated in FIG. 13. The connector connects a pair of electronic circuit boards 1A and 1B to each other and comprises a first connector 2A mounted on one electronic circuit board 1A of the pair of electronic circuit boards and a second connector 2B mounted on the other electronic circuit board 1B.

The first connector 2A has a structure in which a plurality of female contacts 4A and a plurality of male contacts 5A are alternately arranged in an arrangement direction R in a housing 3A made from an insulator. Each of the female contacts 4A has its full length in a fitting direction enclosed by the housing 3A, and each of the male contacts 5A is held such that a tip portion thereof protrudes from the housing 3A in the fitting direction.

Similarly, the second connector 2B has a structure in which a plurality of female contacts 4B and a plurality of male contacts 5B are alternately arranged in the arrangement direction R in a housing 3B made from an insulator. Each of the female contacts 43 has its full length in the fitting direction enclosed by the housing 3B, and each of the male contacts 5B is held such that a tip portion thereof protrudes from the housing 3B in the fitting direction.

As the electronic circuit boards 1A and 1B come close to each other, the male contacts 5A of the first connector 2A come into contact with the female contacts 4B of the second connector 2B while the male contacts 5B of the second connector 2B come into contact with the female contacts 4A of the first connector 2A, whereby the first connector 2A and the second connector 2B are connected with each other.

However, since the housing 3A of the first connector 2A encloses the respective female contacts 4A, there exists, between each of the female contacts 4A and an adjacent male contact 5A, an insulator wall 6A made of the insulator forming the housing 3A. Similarly, since the housing 3B of the second connector 2B encloses the respective female contacts 4B, there exists, between each the female contacts 4B and an adjacent male contact 5B, an insulator wall 6B made of the insulator forming the housing 3B.

Accordingly, when the width, in the arrangement direction R, of each of the female contacts 4A and 4B is denoted by D1, the width of each of the insulator walls 6A and 6B by D2, and the width of each of the male contacts 5A and 5B by D3, a distance between the centers of the female contact 4A and of an adjacent male contact 5A or between the centers of the female contact 4B and of an adjacent male contact 5B represents an arrangement pitch P, which has a value not smaller than a sum of D1/2, D2 and D3/2. In other words, the arrangement pitch P is expressed by the following expression:

$$P \geq D1/2 + D2 + D3/2 \quad (1),$$

and it was difficult to decrease the arrangement pitch P.

SUMMARY OF THE INVENTION

The present invention has been made in order to solve the conventional problem described above and is aimed at providing a connector capable of narrowing the arrangement pitch even if the female contacts and the male contacts are alternately arranged.

A connector according to the present invention comprises:

a first connector; and a second connector fitted with the first connector along a fitting direction, wherein the first connector includes: a plurality of first female contacts arranged in an arrangement direction crossing the fitting direction and extending in the fitting direction; and a plurality of first male contacts arranged in the arrangement direction and extending along the fitting direction farther than the plurality of first female contacts, wherein the plurality of first female contacts and the plurality of first male contacts are arranged alternately in the arrangement direction, wherein a first insulation portion is disposed between each of the first female contacts and an adjacent first male contact, wherein the second connector includes: a plurality of second female contacts arranged in the arrangement direction, extending in the fitting direction and coming into contact with corresponding first male contacts of the first connector when the first connector and the second connector are fitted with each other; and a plurality of second male contacts arranged in the arrangement direction, extending along the fitting direction farther than the plurality of second female contacts and coming into contact with corresponding first female contacts of the first connector when the first connector and the second connector are fitted with each other, wherein the plurality of second female contacts and the plurality of second male contacts are arranged alternately in the arrangement direction, wherein a second insulation portion is disposed between each of the second female contacts and an adjacent second male contact, wherein one of the first connector and the second connector is provided with a pair of aligning recesses respectively at opposite ends thereof in the arrangement direction, the aligning recesses opening frontward in the fitting direction, wherein another of the first connector and the second connector is provided with a pair of aligning protrusions respectively at opposite ends thereof in the arrangement direction, the aligning protrusions protruding frontward in the fitting direction, wherein, when the first connector and the second connector are fitted with each other, the pair of aligning protrusions are caught in the pair of aligning recesses, fitting direction from the plurality of second female contacts, and wherein, provided that, in the arrangement direction, a width of each of the first female contacts and the second female contacts when the first connector and the second connector are fitted with each other is denoted by W1, a width of the first insulation portion and the second insulation potion by W2, and a width of each of the first male contacts and the second male contacts by W3, a distance between centers of one of the first female contacts and an adjacent first male contact and a distance between centers of one of the second female contacts and an adjacent second male contact are each smaller than a sum of W1/2, W2 and W3/2.

DETAILED DESCRIPTION OF THE INVENTION

An embodiment of the present invention is described below based on the appended drawings.

Figure 1:
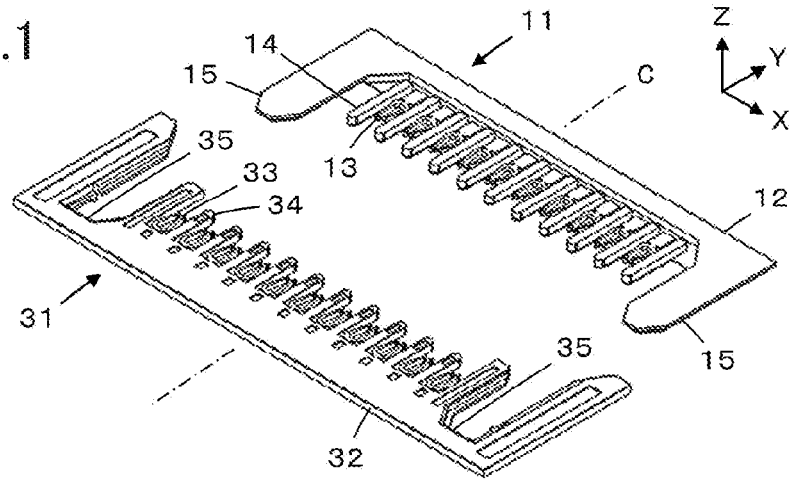
FIG. 1 is a perspective view illustrating a first connector and a second connector of a connector before fitting with each other according to an embodiment of the present invention.

FIG. 1 illustrates a configuration of a connector according to the embodiment of the present invention. The connector comprises a flat plate first connector 11 and a flat plate second connector 31, and the first connector 11 and the second connector 31 slide on each other in a fitting direction along a fitting axis C to be fitted with each other. FIG. 1 illustrates the first connector 11 and the second connector 31 before fitting, the first connector 11 and the second connector 31 being placed in parallel with each other at an interval.

The first connector 11 includes a first connector main body 12, a plurality of first female contacts 13 and a plurality of first male contacts 14, the first connector main body 12 extending in a direction orthogonal to the fitting axis C, and the plurality of first female contacts 13 and the plurality of first male contacts 14 being held by the first connector main body 12 and arranged alternately in a direction orthogonal to the fitting axis C. Meanwhile, the second connector 31 includes a second connector main body 32, a plurality of second female contacts 33 and a plurality of second male contacts 34, the second connector main body 32 extending in a direction orthogonal to the fitting axis C, and the plurality of second female contacts 33 and the plurality of second male contacts 34 being held by the second connector main body 32 and arranged alternately in a direction orthogonal to the fitting axis C.

The first connector main body 12 is provided at its opposite end parts respectively with a pair of aligning protrusions 15 that lie along the fitting axis C and protrude toward the second connector 31, and the second connector main body 32 is provided at its opposite end parts respectively with a pair of aligning recesses 35 that lie along the fitting axis C and open toward the first connector 11.

Since the aligning protrusion 15 has a shape corresponding to that of the aligning recess 35, the pair of aligning protrusions 15 are respectively caught in the pair of aligning recesses 35 so that the first connector 11 and the second connector 31 are aligned at the time of fitting.

For convenience, a plane along which the flat plate first connector 11 and second connector 31 extend is referred to as XY plane, an arrangement direction of the first female contacts 13 and the first male contacts 14 as well as the second female contacts 33 and the second male contacts 34 as X direction, a direction from the second connector 31 toward the first connector 11 along the fitting axis C as +Y direction, and a direction perpendicular to the XY plane as Z direction.

Looking from the first connector 11 side, the −Y direction comes to the front in the fitting direction to be fitted with the second connector 31, and looking from the second connector 31 side, the +Y direction comes to the front in the fitting direction to be fitted with the first connector 11.

Figure 2A:
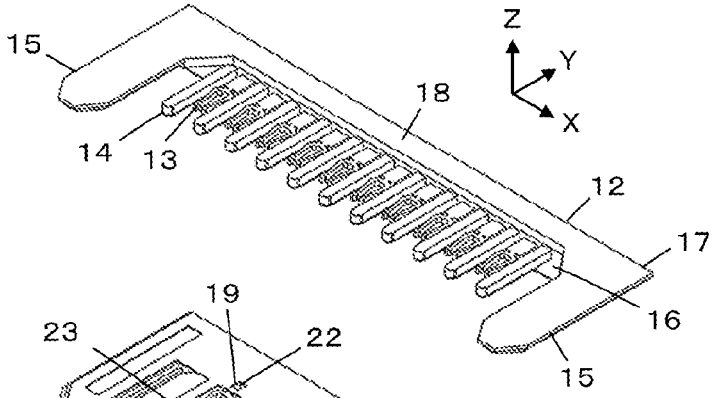
FIGS. 2A to 2E are a perspective view when viewed obliquely from above, a perspective view when viewed obliquely from below, a plan view, a bottom view and a front view, respectively, illustrating the first connector used in the embodiment.
Figure 2B:
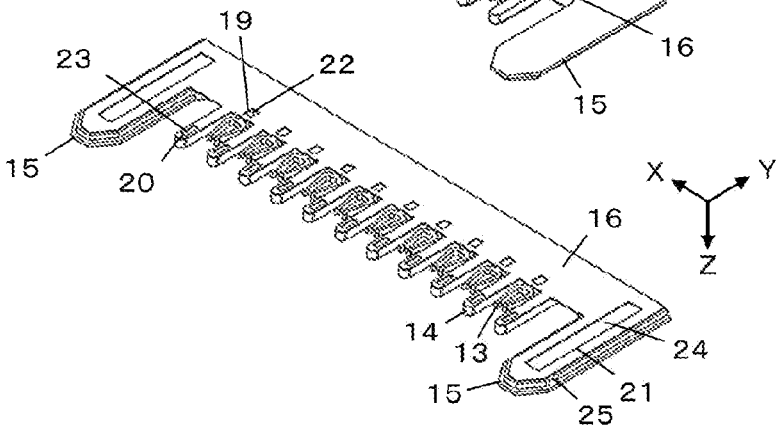
Figure 2C:
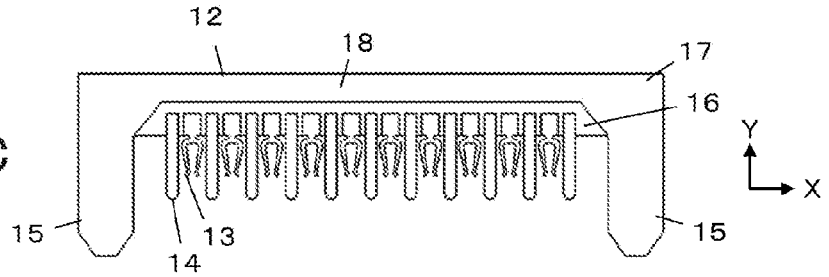
Figure 2D:
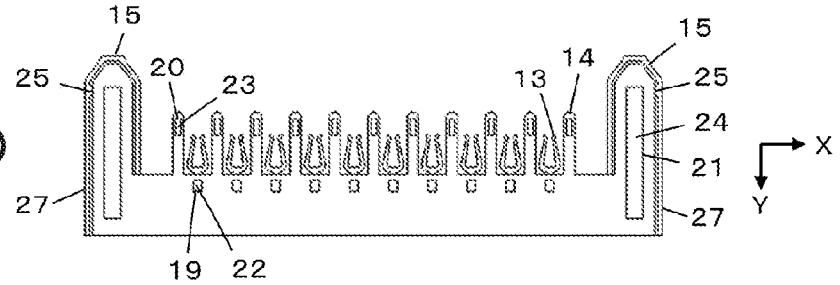
Figure 2E:
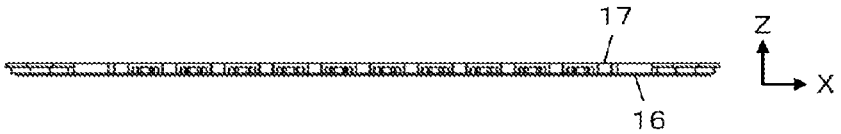

A configuration of the first connector 11 is illustrated in FIGS. 2A to 2E. The first connector 11 has a two-layered structure in which a first insulator sheet 16 and a first conductive layer 17 are superimposed such that the first conductive layer 17 is disposed on the surface on the +Z direction side of the first insulator sheet 16 as illustrated in FIG. 2E.

The first conductive layer 17 includes a connecting portion 18 extending along the X direction in the first connector main body 12, the first female contacts 13 and the first male contacts 14. The connecting portion 18 and the first insulator sheet 16 constitute the first connector main body 12. The first female contacts 13 and the first male contacts 14 are insulated from each other and from the connecting portion 18. The first male contacts 14 extend more frontward in the fitting direction, i.e., in the −Y direction, than the first female contacts 13, while the pair of aligning protrusions 15 extend even farther in the −Y direction than the first male contacts 14.

The first insulator sheet 16 is provided with a plurality of through-holes 19 corresponding to the first female contacts 13, a plurality of through-holes 20 corresponding to the first male contacts 14 and a pair of through-holes 21 corresponding to the connecting portion 18. The first female contacts 13 are provided with a plurality of mounting portions 22, the first male contacts re provided with a plurality of mounting portions 23, and the connecting portion 18 is provided with a pair of mounting portions 24, the mounting portions 22, 23 and 24 being exposed on the −Z direction side via the through-holes 19, 20 and 21, respectively. The mounting portions 22 to 24 are connected to pads of a first connection subject (not shown) such as a board, on which the first connector 11 is mounted.

Each of the aligning protrusions 15 formed at the opposite ends in the X direction of the first connector main body 12 has a taper shape tapering frontward in the fitting direction, i.e., in the −Y direction and is provided with a recess-like lock receiving portion 25 at its end in the X direction on the side away from the first female contacts 13 and the first male contacts 14.

Figure 3:
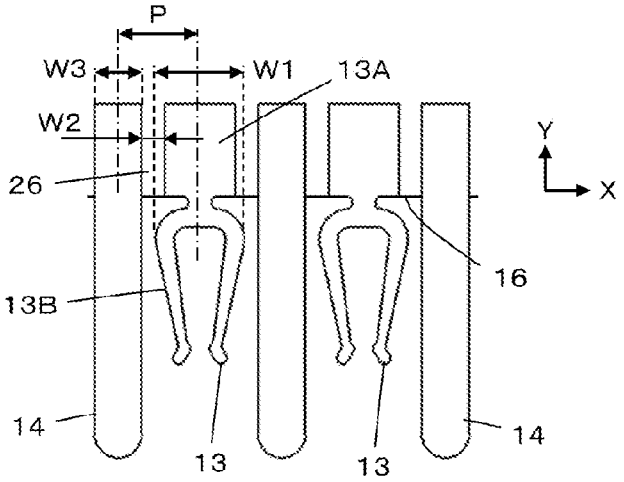
FIG. 3 is a partial plan view illustrating first female contacts and first male contacts of the first connector.

As illustrated in FIG. 3, each of the first female contacts 13 includes a rectangular fixing portion 13A that is fixed on the surface of the first insulator sheet 16, and a bifurcated, U-shaped spring contact portion 13B that is connected to the fixing portion 13A and extends in the −Y direction. The first insulator sheet 16 is present neither on the +Z direction side nor the −Z direction side of the spring contact portion 13B. The spring contact portion 13B is formed to be wider in the X direction than the fixing portion 13A, extending farther in the direction and −X direction than the fixing portion 13A.

Meanwhile, the first male contacts 14 each have a uniform width in the X direction and are fixed to the surface of the first insulator sheet 16 over their entire length in the Y direction.

In addition, the surface of the first insulator sheet 16 is exposed between the fixing portion 13A of each of the first female contacts 13 and an adjacent first male contact 14 so as to form a first insulation portion 26 between the fixing portion 13A and the adjacent first male contact 14.

Here, since the spring contact portion 13B of each of the first female contacts 13 is wider in the X direction than the fixing portion 13A, when the width of each of the first female contacts 13 (width of the spring contact portion 13B) is denoted by W1, the width of the first insulation portion 26 by W2, and the width of each of the first male contacts 14 by W3 in the X direction, i.e., the arrangement direction of the first female contacts 13 and the first male contacts 14, an arrangement pitch P of the first female contacts 13 and the first male contacts 14 expressed by a distance between the centers of the first female contact 13 and an adjacent first male contact 14 has a value smaller than a sum of W1/2, W2 and W3/2. In other words, the arrangement pitch P is expressed by the following expression:

$$P<W1/2+W2+W3/2 \quad (2).$$

The expression (2) is established because the first insulation portion 26 is not an insulator wall formed between the spring contact portion 13B of each of the first female contacts 13 and an adjacent first male contact 14 but is disposed between the fixing portion 13A of each of the first female contacts 13 and an adjacent first male contact 14, whereby the arrangement pitch of the contacts in the first connector 11 can be narrowed.

When the spring contact portion 13B of each of the first female contacts 13 shifts in the X direction at the time of fitting of the first connector 11 and the second connector 31, if the width of the first female contact 13 increases as compared to when the first and second connectors 11 and 31 are not fitted, the increased width of the first female contact 13 at the time of fitting can be treated as W1.

Figure 4:
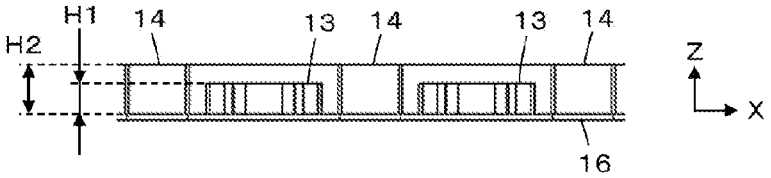
FIG. 4 is a partial front view illustrating the first female contacts and the first male contacts of the first connector.

As illustrated in FIG. 4, a height H2 of each of the first male contacts 14 is set to have a larger value than that of a height H1 of each of the first female contacts 13 on the surface of the first insulator sheet 16. The first male contacts 14 that are higher than the first female contacts 13 and extend farther in the −Y direction than the first female contacts 13 as described above are disposed on both sides in the X direction of each of the first female contacts 13, and thus the first female contacts 13 having the spring contact portions 13B are protected.

Figure 5:
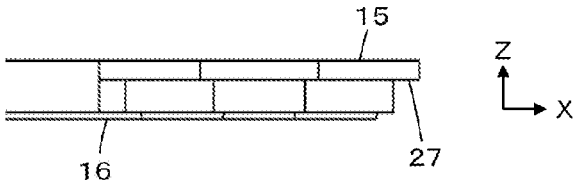
FIG. 5 is a partial front view illustrating an aligning protrusion of the first connector.

Moreover, as illustrated in FIG. 5, each of the aligning protrusions 15 is provided with an overhanging portion 27 that overhangs in the XY plane in parallel with the first insulator sheet 16.

The first connector 11 having such configuration can be produced through the step of forming the first conductive layer 17 by plating the surface of the first insulator sheet 16 that is provided in advance with the plurality of through-holes 19 to 21.

Note that the first conductive layer 17 can be formed also by etching, in place of plating.

Figure 6A:
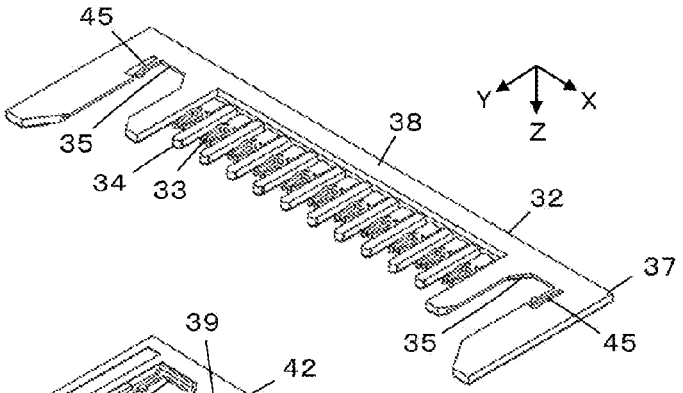
FIGS. 6A to 6E are a perspective view when viewed obliquely from above, a perspective view when viewed obliquely from below, a plan view, a bottom view and a front view, respectively, illustrating the second connector used in the embodiment.
Figure 6B:
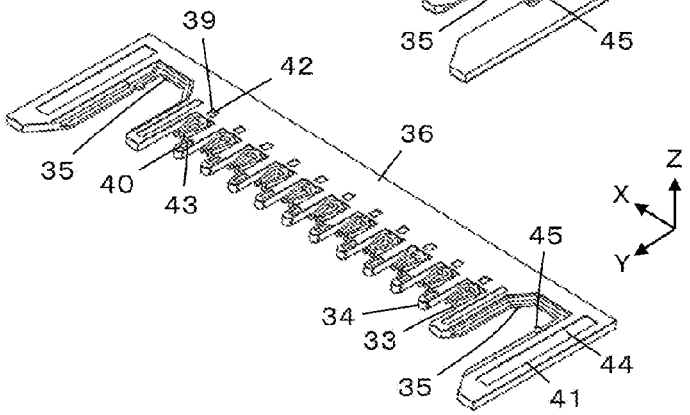
Figure 6C:
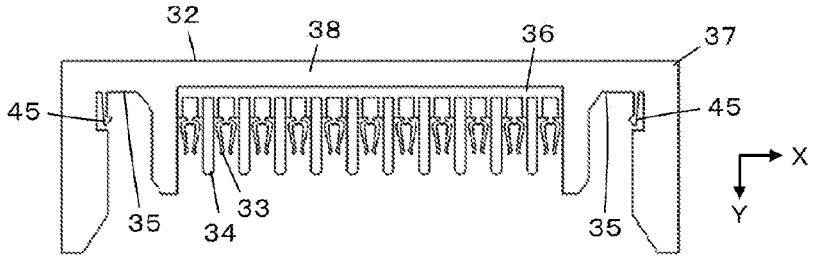
Figure 6D:
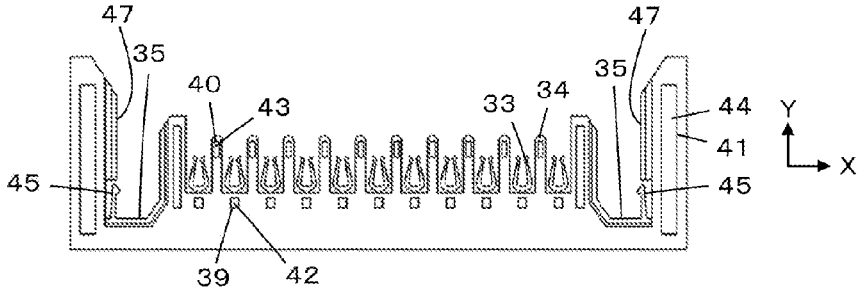
Figure 6E:
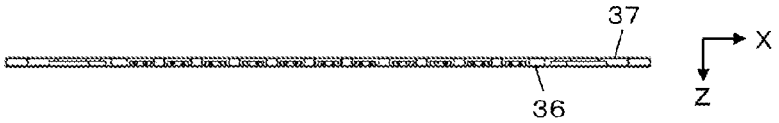

Next, a configuration of the second connector 31 is illustrated in FIGS. 6A to 6E. The second connector 31 has the same configuration as that of the first connector 11 except that a pair of aligning recesses 35 are provided in place of the pair of aligning protrusions 15. More specifically, the second connector 31 has a two-layered structure in which a second insulator sheet 36 and a second conductive layer 37 are superimposed such that the second conductive layer 37 is disposed on the surface on the −Z direction side of the second insulator sheet 36 as illustrated in FIG. 6E.

The second conductive layer 37 includes a connecting portion 38 extending along the X direction in the second connector main body 32, a plurality of second female contacts 33 and a plurality of second male contacts 34, and the connecting portion 38 and the second insulator sheet 36 constitute the second connector main body 32. The second female contacts 33 and the second male contacts 34 are insulated from each other and from the connecting portion 38. The second male contacts 34 extend more frontward in the fitting direction, i.e., in the +Y direction, than the second female contacts 33.

The second insulator sheet 36 is provided with a plurality of through-holes 39 corresponding to the second female contacts 33, a plurality of through-holes 40 corresponding to the second male contacts 34 and a pair of through-holes 41 corresponding to the connecting portion 38. The second female contacts 33 are provided with a plurality of mounting portions 42, the second male contacts 34 are provided with a plurality of mounting portions 43, and the connecting portion 38 is provided with a pair of mounting portions 44, the mounting portions 42, 43 and 44 being exposed on the +Z direction side via the through-holes 39, 40 and 41, respectively. The mounting portions 42 to 44 are connected to pads of a second connection subject (not shown) such as a board, on which the second connector 31 is mounted.

In addition, the second connector main body 32 is provided with lock portions 45 that are respectively formed in the pair of aligning recesses 35 and are capable of shifting in the X direction.

Moreover, each of the aligning recesses 35 is provided with an overhanging portion 47 that overhangs in the XY plane in parallel with the second insulator sheet 36.

Figure 7:
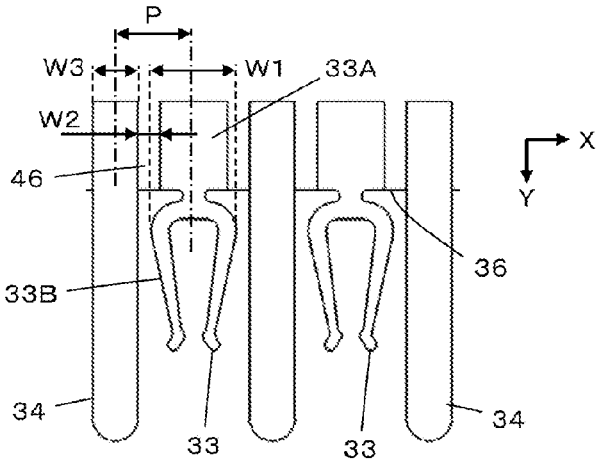
FIG. 7 is a partial plan view illustrating second female contacts and second male contacts of the second connector.

As illustrated in FIG. 7, each of the second female contacts 33 includes a rectangular fixing portion 33A that is fixed on the surface of the second insulator sheet 36, and a bifurcated, U-shape spring contact portion 33B that is connected to the fixing portion 33A and extends in the +Y direction. The second insulator sheet 36 is present neither on the +Z direction side nor the −Z direction side of the spring contact portion 33B. The spring contact portion 33B is formed to be wider in the X direction than the fixing portion 33A, extending farther in the +X direction and −X direction than the fixing portion 33A.

Meanwhile, the second male contacts 34 each have a uniform width in the X direction and are fixed to the surface of the second insulator sheet 36 over their entire length in the Y direction.

In addition, the surface of the second insulator sheet 36 is exposed between the fixing portion 33A of each of the second female contacts 33 and an adjacent second male contact 34 so as to form a second insulation portion 46 between the fixing portion 33A and the adjacent second male contact 34.

The second female contacts 33, the second male contacts 34 and the second insulation portions 46 of the second connector 31 are same as the first female contacts 13, the first male contacts 14 and the first insulation portions 26 of the first connector 11, respectively, in shape and size. Moreover, the arrangement pitch of the second female contacts 33 and the second male contacts 34 that is expressed by a distance between the centers of a second female contact 33 and an adjacent second male contact 34 has the same value as that of the arrangement pitch P of the first female contacts 13 and the first male contacts 14 of the first connector 11.

Accordingly, as illustrated in FIG. 7, the second female contact 33 has a width W1, the second insulation portion 46 has a width W2, and the second male contact 34 has a width W3 in the X direction, and, therefore, the arrangement pitch P of the second female contacts 33 and the second male contacts 34 expressed by a distance between the centers of the second female contact 33 and an adjacent second male contact 34 has a value smaller than the sum of W1/2, W2 and W3/2. That is, the above expression (2) is established also in the second connector 31.

The equation (2) is established since the second insulation portion 46 is not an insulator wall formed between the spring contact portion 33B of each of the second female contacts 33 and an adjacent second male contact 34 but is disposed between the fixing portion 33A of each of the second female contacts 33 and an adjacent second male contact 34, whereby the arrangement pitch of the contacts in the second connector 31 can be narrowed.

When the spring contact portion 33B of each of the second female contacts 33 shifts in the X direction at the time of fitting of the first connector 11 and the second connector 31, if the width of the second female contact 33 increases as compared to when the first and second connectors 11 and 31 are not fitted, the increased width of the second female contact 33 at the time of fitting can be treated as W1.

Figure 8:
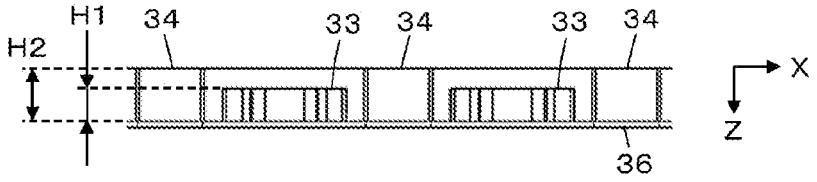
FIG. 8 is a partial front view illustrating the female spring contacts and the second male contacts of the second connector.

As illustrated in FIG. 8, a height H2 of each of the second male contacts 34 is set to have a larger value than that of a height H1 of each of the second female contacts 33 on the surface of the second insulator sheet 36, and the second male contacts 34 that are higher than the second female contacts 33 and extend farther in the +Y direction than the second female contacts 33 are disposed on both sides in the X direction of each of the second female contacts 33, whereby the second female contacts 33 having the spring contact portions 33B are protected.

The second connector 31 having such configuration can be produced through the step of forming the second conductive layer 37 by plating the surface of the second insulator sheet 36 that is provided in advance with the plurality of through-holes 39 to 41.

Note that the second conductive layer 37 can be formed also by etching, in place of plating.

When the first connector 11 is fitted with the second connector 31, as illustrated in FIG. 1, the first connector 11 and the second connector 31 are placed to oppose each other in the Y direction such that the first insulator sheet 16 of the first connector 11 faces in the −Z direction, the second insulator sheet 36 of the second connector 31 faces in the +Z direction, and the first female contacts 13 and the first male contacts 14 of the first connector 11 are substantially aligned with the second female contacts 33 and the second male contacts 34 of the second connector 31, respectively, in the Z direction.

Figure 9:
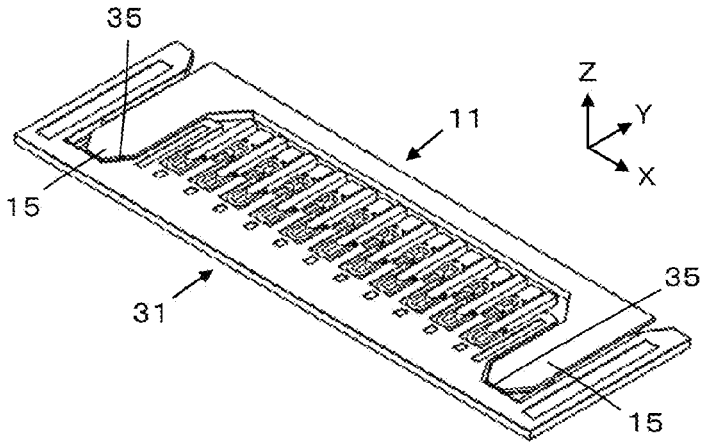
FIG. 9 is a perspective view illustrating the first connector and the second connector as being fitted with each other.
Figure 10:
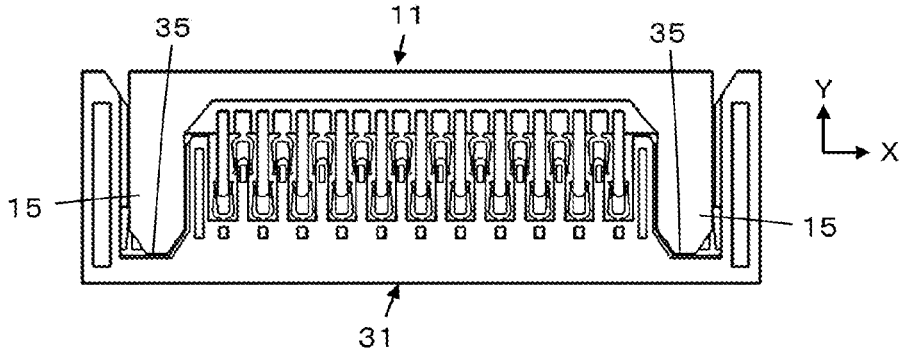
FIG. 10 is a plan view illustrating the first connector and the second connector as being fitted with each other.

In this positional relation, as illustrated in FIGS. 9 and 10, the first connector 11 is slid on the second connector 31 in the −Y direction, causing the pair of aligning protrusions 15 of the first connector 11 to be caught in the pair of aligning recesses 35 of the second connector 31, whereby the first connector 11 and the second connector 31 are fitted with each other.

At this time, since each of the aligning protrusions 15 of the first connector 11 has a taper shape tapering frontward in the fitting direction, i.e., in the −Y direction, the first connector 11 and the second connector 31 can be correctly fitted even if the first connector 11 and the second connector 31 are slid on each other as being slightly misaligned in the XY plane.

Figure 11:
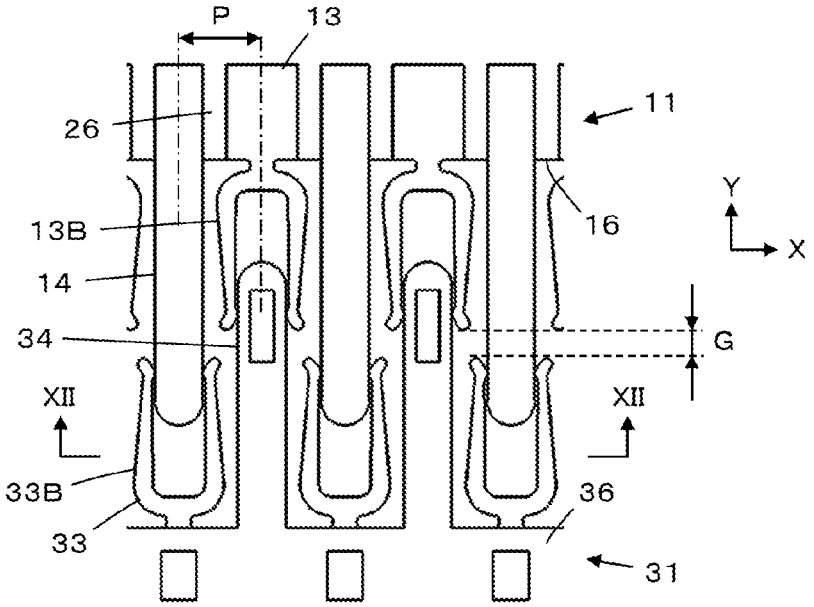
FIG. 11 is a plan view illustrating e first female contacts and the first male contacts of the first connector and the second female contacts and the second male contacts of the second connector when the first connector and the second connector are fitted with each other.

In addition, as the pair of aligning protrusions 15 of the first connector 11 are caught in the pair of aligning recesses 35 of the second connector 31, tip ends the first female contacts 13 of the first connector 11 and tip ends of the second female contacts 33 of the second connector 31 are located so as to have a gap G therebetween in the Y direction, i.e., the fitting direction, as illustrated in FIG. 11.

The spring contact portion 13B of each of the first female contacts 13 of the first connector 11 shifts in the X direction to hold the corresponding male contact 34 of the second connector 31 at both sides thereof, whereby electrical connection between the first female contact 13 and the second male contact 34 is established. At the same time, the spring contact portion 33B of each of the second female contacts 33 of the second connector 31 shifts in the X direction to hold the corresponding first male contact 14 of the first connector 11 at both sides thereof, whereby electrical connection between the second female contact 33 and the first male contact 14 is established.

Since being apart from each other by a gap G in the Y direction, the spring contact portion 13B of the first female contact 13 of the first connector 11 and the spring contact portion 33B of the second female contact 33 of the second connector 31 can shift in the X direction without interfering with each other.

As described above, since the distance between the centers of a first female contact 13 and an adjacent first male contact 14 and the distance between the centers of a second female contact 33 and an adjacent second male contact 34 satisfy the above expression (2) and each have the smaller value than the sum of the value W1/2 that is ½ of the width W1 of the first female contact 13 or the second female contact 33, the width W2 of the first insulation portion 26 or the second insulation portion 46 and the value W3/2 that is ½ of the width W3 of the first male contact 14 or the second male contact 34, the arrangement pitch of the first female contacts 13 and the first male contacts 14 as well as the second female contacts 33 and the second male contacts 34, that are even alternately arranged, can be narrowed.

Figure 12:
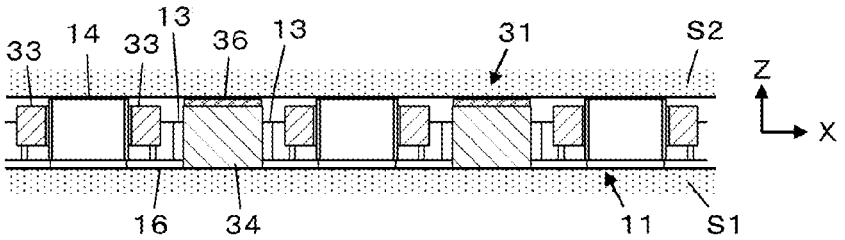
FIG. 12 is a cross-sectional view taken along line XII–XII of FIG. 11.
Figure 13:
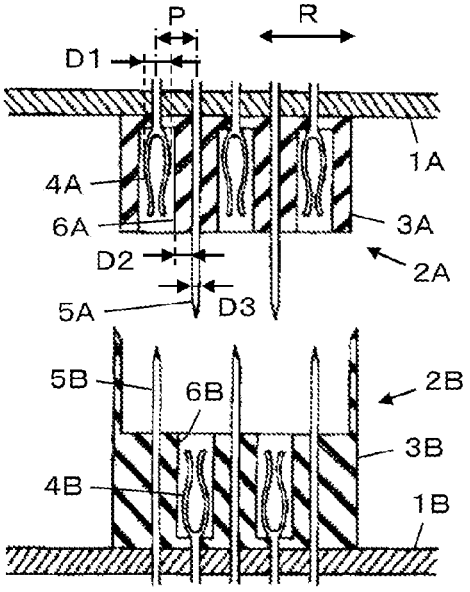
FIG.13 PRIOR ART
FIG. 13 is a cross-sectional view illustrating a structure of a conventional connector.

As illustrated in FIG. 12, the first connector 11 is mounted on the first connection subject S1 with the mounting portions 22 to 24 being connected to the corresponding pads of the first connection subject S1, while the second connector 31 is mounted on the second connection subject S2 with the mounting portions 42 to 44 being connected to the corresponding pads of the second connection subject S2, and the first connector 11 is fitted with the second connector 31, whereby electrical connection between the first connection subject Si and the second connection subject S2 can be established.

When the aligning protrusions 15 of the first connector 11 are caught in the aligning recesses 35 of the second connector 31, the overhanging portion 27 formed at each of the aligning protrusions 15 of the first connector 11 is superimposed, on the +Z direction side, on an overhanging portion 47 formed at each of the aligning recesses 35 of the second connector 31, and the first connector 11 and the second connector 31 fitted with each other thus can be prevented from falling off in the Z direction.

In addition, when the aligning protrusions 15 of the first connector 11 are caught in the aligning recesses 35 of the second connector 31, the lock portion 45 formed in each of the aligning recesses 35 of the second connector 31 enters the recess-like lock receiving portion 25 formed at an end, in the X direction, of each of the aligning protrusions 15 of the first connector 11 so that the first connector 11 and the second connector 31 fitted with each other can be prevented from falling off in the Y direction.

Accordingly, the fitting state of the first connector 11 with the second connector 31 is maintained, and reliable electrical connection between the first female contacts 13 and the second male contacts 34 as well as between the second female contacts 33 and the first male contacts 14 can be established.

In the above-described embodiment, the first female contacts 13, the first male contacts 14 and the first insulation portions 26 of the first connector 11 are same as the second female contacts 33, the second male contacts 34 and the second insulation portions 46 of the second connector 31, respectively, in size and shape. However, they may be different in size and shape as long as the first female contacts 13 and the second female contacts 33 are electrically connected to the second male contacts 34 and the first male contacts 14, respectively, when the first connector 11 is fitted with the second connector 31.

When the first female contacts 13, the first male contacts 14 and the first insulation portions 26 of the first connector 11 satisfy the above expression (2), and the second female contacts 33, the second male contacts 34 and the second insulation portions 46 of the second connector 31 satisfy the above expression (2), the arrangement pitch can be narrowed.

In the above-described embodiment, the first connector 11 and the second connector 31 each have a flat plate shape. However, this is not the sole case, and the first connector 11 and the second connector 31 may have other shapes than a flat plate shape.

What is claimed is:

1. A connector comprising:

a first connector; and a second connector fitted with the first connector along a fitting direction, wherein the first connector includes: a plurality of first female contacts arranged in an arrangement direction crossing the fitting direction and extending in the fitting direction; and a plurality of first male contacts arranged in the arrangement direction and extending along the fitting direction farther than the plurality of first female contacts, wherein the plurality of first female contacts and the plurality of first male contacts are arranged alternately in the arrangement direction, wherein a first insulation portion is disposed between each of the first female contacts and an adjacent first male contact, wherein the second connector includes: a plurality of second female contacts arranged in the arrangement direction, extending in the fitting direction and coming into contact with corresponding first male contacts of the first connector when the first connector and the second connector are fitted with each other; and a plurality of second male contacts arranged in the arrangement direction, extending along the fitting direction farther than the plurality of second female contacts and coming into contact with corresponding first female contacts of the first connector when the first connector and the second connector are fitted with each other, wherein the plurality of second female contacts and the plurality of second male contacts are arranged alternately in the arrangement direction, wherein a second insulation portion is disposed between each of the second female contacts and an adjacent second male contact, wherein one of the first connector and the second connector is provided with a pair of aligning recesses respectively at opposite ends thereof in the arrangement direction, the aligning recesses opening frontward in the fitting direction, wherein another of the first connector and the second connector is provided with a pair of aligning protrusions respectively at opposite ends thereof in the arrangement direction, the aligning protrusions protruding frontward in the fitting direction, wherein, when the first connector and the second connector are fitted with each other, the pair of aligning protrusions are caught in the pair of aligning recesses, and the plurality of first female contacts are apart in the fitting direction from the plurality of second female contacts, and wherein, provided that, in the arrangement direction, a width of each of the first female contacts and the second female contacts when the first connector and the second connector are fitted with each other is denoted by W1, a width of the first insulation portion and the second insulation potion by W2, and a width of each of the first male contacts and the second male contacts by W3, a distance between centers of one of the first female contacts and an adjacent first male contact and a distance between centers of one of the second female contacts and an adjacent second male contact are each smaller than a sum of W1/2, W2 and W3/2.

2. The connector according to claim 1, wherein the first connector includes a first insulator sheet, the plurality of first female contacts and the plurality of first male contacts being disposed on a surface of the first insulator sheet, wherein the first insulation portion is made of a portion of the first insulator sheet exposed between each of the first female contacts and an adjacent first male contact, wherein the second connector includes a second insulator sheet, the plurality of second female contacts and the plurality of second male contacts being disposed on a surface of the second insulator sheet, wherein the second insulation portion is made of a portion of the second insulator sheet exposed between each of the second female contacts and an adjacent second male contact, and wherein the first connector and the second connector are slid on each other in the fitting direction to be fitted with each other, with the first connector and the second connector being disposed such that a rear surface of the first insulator sheet and a rear surface of the second insulator sheet both face outward.

3. The connector according to claim 2, wherein the first male contacts each have a higher height than a height of the first female contacts on the surface of the first insulator sheet, and the second male contacts have a higher height than a height of the second female contacts on the surface of the second insulator sheet.

4. The connector according to claim 2, wherein the plurality of first female contacts and the plurality of first male contacts are each provided with a mounting portion that is exposed on the rear surface side of the first insulator sheet, and the plurality of second female contacts and the plurality of second male contacts are each provided with a mounting portion that is exposed on the rear surface side of the second insulator sheet.

5. The connector according to claim 2, wherein the pair of aligning recesses and the pair of aligning protrusions are each provided with an overhanging portion overhanging in parallel with the first insulator sheet or the second insulator sheet, and wherein the overhanging portion of each of the pair of aligning recesses and the overhanging portion of each of the pair of aligning protrusions are superimposed on one another when the first connector and the second connector are fitted with each other.

6. The connector according to claim 2, wherein the plurality of first female contacts and the plurality of first male contacts of the first connector and the plurality of second female contacts and the plurality of second male contacts of the second connector are each formed through plating.

7. The connector according to claim 1, wherein either one of the pair of aligning recesses and the pair of aligning protrusions have lock portions capable of shifting in the arrangement direction, and wherein the other of the pair of aligning recesses and the pair of aligning protrusions have lock receiving portions, the lock portions being caught in the lock receiving portions when the first connector and the second connector are fitted with each other.

* * * * *